US005281002A

United States Patent [19]

Dauphin

[11] Patent Number: 5,281,002

[45] Date of Patent: Jan. 25, 1994

[54] CHAIR, IN PARTICULAR OFFICE CHAIR

[75] Inventor: Friedrich W. Dauphin, Offenhausen, Fed. Rep. of Germany

[73] Assignees: Friedrich W. Dauphin GmbH & Co.; Entwicklungs - und Beteiligungs-KG, Neukirchen, Fed. Rep. of Germany

[21] Appl. No.: 834,952

[22] Filed: Feb. 14, 1992

[30] Foreign Application Priority Data

Feb. 27, 1991 [DE] Fed. Rep. of Germany ... 9102301[U]

[51] Int. Cl.[5] ..... A47C 7/02; A47C 31/00

[52] U.S. Cl. ..... 297/452.38; 297/219.1; 297/DIG. 6

[58] Field of Search ..... 297/453, 219, 413, DIG. 6

[56] References Cited

U.S. PATENT DOCUMENTS

| | | | |
|---|---|---|---|
| 1,885,109 | 11/1932 | Burkart | 297/219 |
| 3,656,593 | 4/1972 | Bauer . | |
| 3,711,054 | 1/1973 | Bauer . | |
| 3,827,752 | 8/1974 | Bissinger | 297/452 |
| 4,065,181 | 12/1977 | Gunlock | 297/452 |
| 4,072,345 | 2/1978 | Matsuda | 297/452 |
| 4,518,200 | 5/1985 | Armstrong | 297/DIG. 6 |
| 4,900,085 | 2/1990 | Tobler | 297/452 |

*Primary Examiner*—Peter M. Cuomo
*Assistant Examiner*—Flemming Saether
*Attorney, Agent, or Firm*—Browdy and Neimark

[57] ABSTRACT

A chair, in particular an office chair, comprises a seat support with a seat and a back rest having a base plate. The base plate is covered at least on its rear side with a covering made of a flexible material. The base plate and the seat support are interconnected in a fastening region. An opening is provided which accommodates at least the fastening region and which can be closed by a concealing member which is formed by at least one Velcro strip.

9 Claims, 3 Drawing Sheets

CHAIR, IN PARTICULAR OFFICE CHAIR

FIELD OF THE INVENTION

The invention relates to a chair comprising a seat support, which carries a seat, a back rest, which has a base plate which is covered at least on its rear side with a covering made of a flexible material, the base plate and the seat support being interconnected in a fastening region.

BACKGROUND OF THE INVENTION

For chairs of this type, and that in particular for embodiments with a back rest extending far down to the seat and in particular for such embodiments with a back rest covered with a continuously padded covering and with a covered seat the fastening of the back rest at the back rest support is expensive with regard to design and assembly.

SUMMARY OF THE INVENTION

It is an object of the invention to embody a chair of the generic type such that the connection of the back rest with the seat support is possible in a simple and optically attractive manner.

This object is attained according to the invention by an opening being formed in the covering accommodating at least the fastening region, which opening can be closed by a concealing member by means of a fastener. According to the invention a fastening region—as a rule in the lower region of the back rest—is provided, which is accessible through an opening in the covering, which conceals the back rest at its rear side. In this case this is as a rule a padded covering, which covers as a whole the entire back rest and, if necessary, the seat, the base plate of the back rest being as a rule provided with a thin padding also on its rear side. This opening is closed by a concealing member, which is in the most simple and most advantageous embodiment a flap formed in one piece with the covering and made of the material of the covering. The concealing member is connected with the covering in a particularly advantageous manner by means of a Velcro fastener. The fastener can be easily manufactured and can be easily released.

Further advantageous and partially inventuous features become apparent from the dependent claims. Furthermore numerous features, advantages and details of the invention become apparent from the ensuing description of one example of embodiment taken in conjunction with the drawing.

DESCRIPTION OF THE PREFERRED EMBODIMENTS

Figure 1:
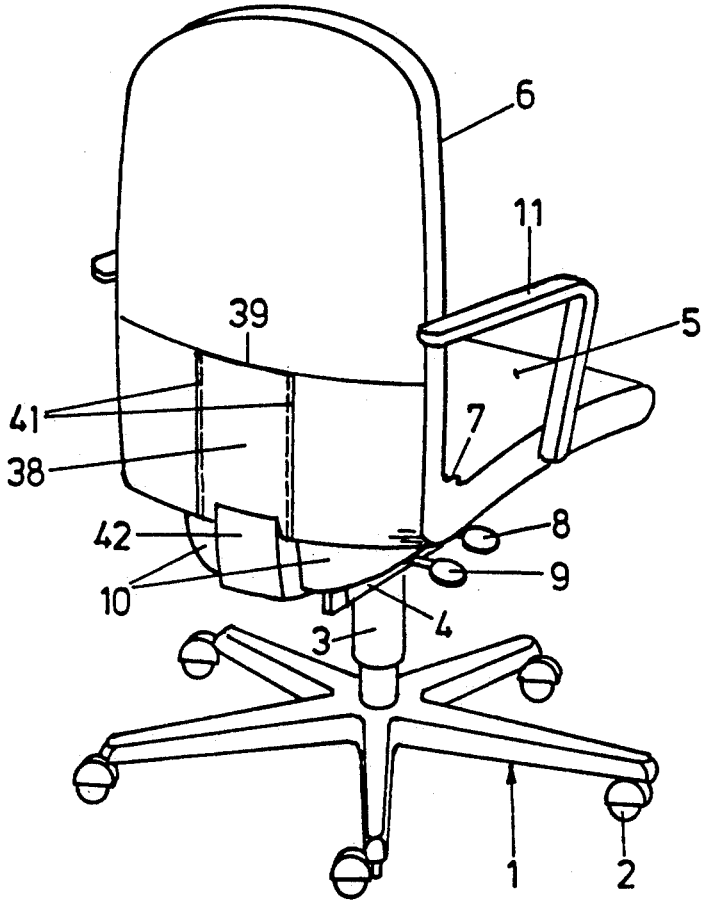
FIG. 1 shows a chair in a perspective view diagonally from the rear.

An office chair shown in FIG. 1 has a pedestal 1, which is supported on the floor by means of casters 2. At the pedestal 1 a chair column 3 which is adjustable in height is disposed, to the upper end of which a seat support 4 is releasably secured, on which a seat 5 is disposed, which is connected in one piece with a back rest 6 by means of a flexible area of transition 7. The height of the chair column 3 is adjusted by means of an operating lever 8 which is fixed in the seat support 4. A further operating lever 9 is fixed at the seat support 4 for the purpose of changing the tilt of the back rest 6 while simultaneously changing the tilt of the seat 5. The seat support 4 can be optically concealed partially or substantially by a casing 10 secured to the lower side of the seat 5. The chair is provided with armrests 11, which are disposed on the one hand in the region of the front side of the seat 5 and on the other hand in the middle part of the height of the back rest 6.

Figure 2:
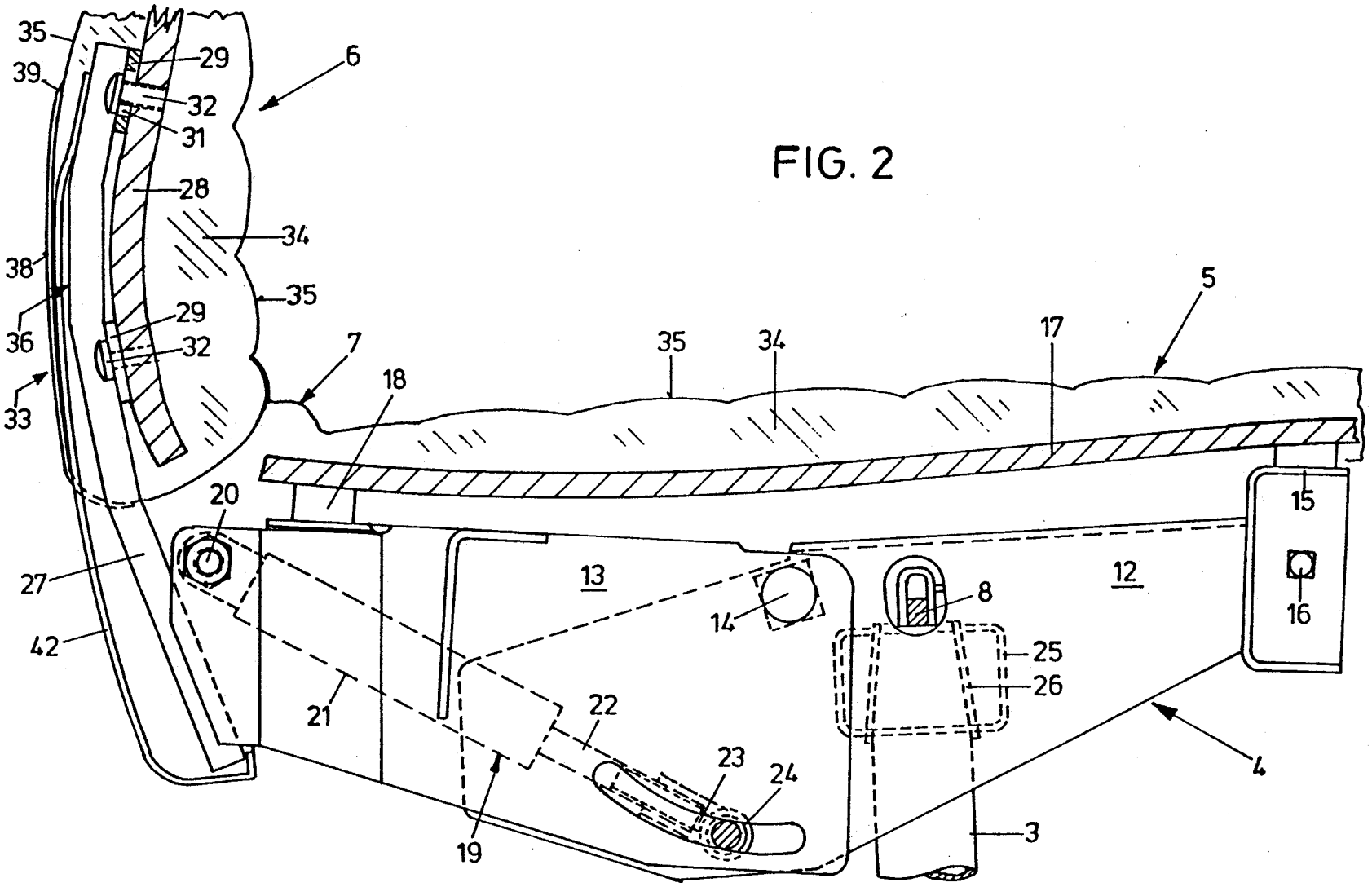
FIG. 2 shows a vertical longitudinal section through a seat support with a part of the back rest of the chair and FIG. 3 shows a partial rear view of the back rest of the chair.

As can be seen from FIG. 2, the seat support 4 is of divided construction. It consists of a front seat support member 12 and a rear seat support member 13. The two seat support members 12, 13 formed as C-profiles are interconnected by a pivot axis 14 located adjacent to their upper side. At the front end of the front seat support member 12 of the seat support 4 a front seat holder 15 is disposed pivotably around a pivot axis 16 which extends parallel to the pivot axis 14. On this front seat holder 15 a seat plate 17 which is rigid in itself is elastically supported and fixed and forms the core of the seat 5. In its rear region facing the back rest 6 the seat plate 17 is also elastically supported and fixed on a rear seat holder 18.

At the rear end of the rear seat support member 13, i.e. approximately in the area of transition 7, a force storage means adjustable in length in the form of a gas spring 19 adjustable in length is articulated around a pivot axis 20, which extends parallel to the pivot axes 14, 16. The housing 21 of the gas spring 19 faces this pivot axis 20, from the other end of which housing 21 a piston rod 22 exits. From this piston rod 22 an actuation pin 23 protrudes, by means of which a valve located in the gas spring 19 can be actuated for the purpose of length adjustment. The piston rod 22 is connected by means of a thread with an actuation device 24, to which the operating lever 9 belongs.

In the front seat support member 12 a pillow block 25 is disposed, in which a downwardly widening conical sleeve 26 which is open at the bottom is formed. The chair column 3 is releasably fixed in this conical sleeve 26. The operating lever 8 is disposed above the pillow block 25.

For length adjustments of the gas spring 19 the front and the rear seat support member 12 or 13 are pivoted in relation to each other around the pivot axis 14, whereby the front seat support member 12 does not change its position because of the rigid—even though releasable—connection with the chair column 3, i.e. the rear seat support member 13 changes its tilt. As a result the tilt of the seat plate 17 of the seat 5 is changed at the same time. The chair column 3 adjustable in height is known for instance from U.S. Pat. No. 3,711,054 or from U.S. Pat. No. 3,656,593. The design of the seat support including the described pivoting possibilities is known for instance from U.S. Pat. No. 4,966,412. The design and disposition of the actuation device 24 and of the gas spring 19 are known from U.S. Pat. No. 4,662,680.

At the rear end of the rear seat support member 13 a rod-shaped back rest support 27 formed of a flat steel is fixed, which extends vertically upwards in a slightly curved manner. At the upper end of the back rest support 27 a base plate 28 of the back rest 6 is fixed. To this effect bracing flanges 29 are disposed in the vicinity of the upper end of the back rest support 27 on both sides and one above the other, which bracing flanges 29 comprise oblong holes 31, extending vertically and thus parallel to the plane of symmetry 30 of the back rest 6. The base plate 28 is screw connected through these oblong holes with the back rest support 27 by means of screws 32. The oblong holes 31 ensure correct adjustment of the relative height of the base plate 28 to the back rest support 27.

Figure 3:
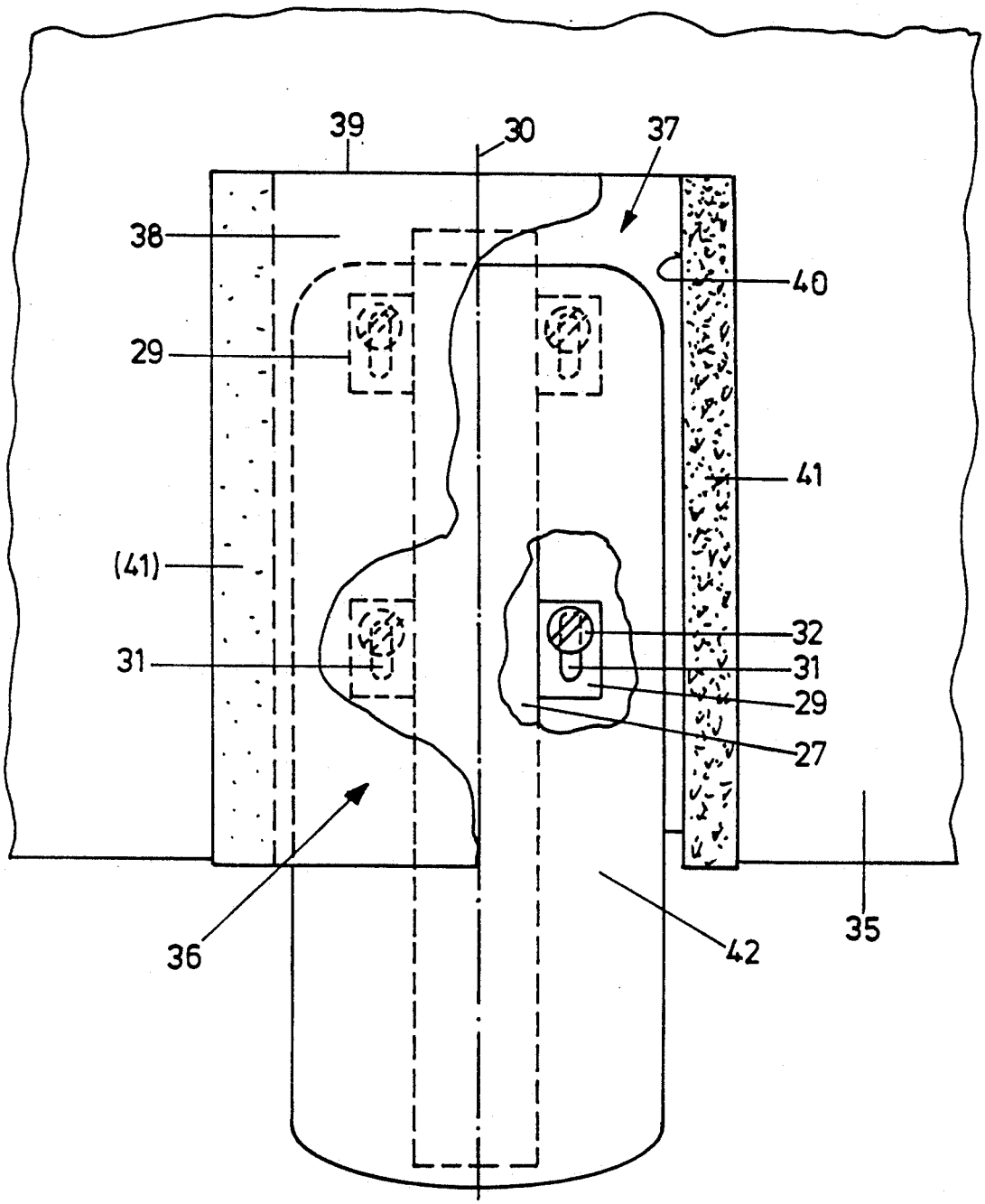

The back rest 6 is provided with a padding 34 on its front side, i.e. the side facing the user and also on its rear side 33, which padding 34 is covered with a padded covering 35. The same is valid for the seat 5 and the area of transition 7. The prefabricated part comprising the back rest 6 with base plate 28, the area of transition 7 and the seat 5 with seat plate 17 and the padding 34 with padded covering 35 is put onto the seat support 4 with the back rest support 27. Then the seat plate 17 is secured to the front and rear seat support member 12 or 13. Furthermore the base plate 28 is connected with the back rest support 27 in the described manner. In order to make this possible, an opening 37 is formed in the fastening region 36 between the back rest support 27 and the base plate 28 in the covering 35 at the rear side 33 of the back rest 6, which opening 37 ensures the described assembly. This—as can be seen from FIG. 3—rectangular opening 37 can be closed by means of a concealing member 38 formed as a flap. This concealing member 38 is made of the material of the padded covering 35 and is formed with the latter in one piece in the vicinity of the upper edge 39 of the opening 37. At their lateral edges extending parallel to the plane of symmetry 30, Velcros 41 are disposed on the covering 35. The concealing member 38 can be fixed to these Velcros 41 by simply putting it on them and pressing it against them, whereby the opening 37 and thus the fastening region 36 are closed virtually invisibly. Before, a blind 42 can be disposed at the back rest support 27, which blind 42 is substantially flush with the region of the padded covering 35 located on both sides of the opening 37, so that the blind 42 simultaneously forms a support plate for the soft concealing member 38. This blind 42 conceals also the lower region of the back rest support 27 and simultaneously the rear region of the rear seat support member 13, as can be seen from FIGS. 2 and 3.

What is claimed is:

1. A chair, in particular an office chair, comprising:

a seat support (4);

a seat (5) carried by said seat support (4);

a back rest (6), having a base plate (28) which is covered at least on a rear side (33) with a covering (35) made of a flexible material and being connected with said seat support (4) in a fastening region (36), wherein the covering (35) is provided with an opening (37) accommodating at least the fastening region (36), and wherein a concealing member (38) formed of the material of the covering (35) is provided closing the opening (37) by means of a fastener (41).

2. A chair according to claim 1, wherein the concealing member (38) is formed as a flap which is connected with the covering (35).

3. A chair according to claim 1, wherein the concealing member (38) is formed in one piece with the covering (35).

4. A chair according to claim 1, wherein the fastener is formed by at least one Velcro strip (41).

5. A chair according to claim 1, wherein the fastening region (36) is formed between said base plate (28) and a back rest support (27) connected with said seat support (4).

6. A chair, in particular an office chair, comprising:

a seat support (4);

a seat (5) carried by said seat support (4);

a back rest (6), having a base plate (28) which is covered at least on a rear side (33) with a covering (35) made of a flexible material and being connected with said seat support (4) in a fastening region (36), wherein the covering (35) is provided with an opening (37) accommodating at least the fastening region (36), wherein a concealing member (38) is provided closing the opening (37) by means of a fastener (41), wherein the concealing member (38) is formed of the material of the covering (35), wherein the fastening region (36) is formed between said base plate (28) and a back rest support (27) connected with said seat support (4), and wherein a support plate (42) for the concealing member (38) is disposed in the opening (37).

7. A chair according to claim 6, wherein the concealing member (38) is formed as a flap which is connected with the covering (35).

8. A chair according to claim 6, wherein the concealing member (38) is formed in one piece with the covering (35).

9. A chair according to claim 6, wherein the fastener is formed by at least one Velcro strip (41).

* * * * *